US005512236A

United States Patent [19]

Jones et al.

[11] Patent Number: 5,512,236

[45] **Date of Patent: * Apr. 30, 1996**

[54] SINTERED COINING PROCESS

[75] Inventors: Peter Jones, Toronto; Roger Lawcock, Burlington, both of Canada

[73] Assignee: Stackpole Limited, Toronto, Canada

[ * ] Notice: The portion of the term of this patent subsequent to Jan. 14, 2014, has been disclaimed.

[21] Appl. No.: 107,845

[22] PCT Filed: Dec. 21, 1992

[86] PCT No.: PCT/CA92/00555

§ 371 Date: Aug. 25, 1994

§ 102(e) Date: Aug. 25, 1994

[87] PCT Pub. No.: WO94/14991

PCT Pub. Date: Jul. 7, 1994

[51] Int. Cl.[6] ..... B22F 3/12

[52] U.S. Cl. ..... 419/28; 419/11; 419/32; 419/23; 419/36; 419/39; 419/38; 419/56; 419/58; 419/60; 419/29; 419/37

[58] Field of Search ..... 419/11, 23, 32, 419/36, 39, 38, 56, 58, 60, 28, 29, 37; 148/126; 75/238, 246, 255

[56] References Cited

U.S. PATENT DOCUMENTS

| | | | |
|---|---|---|---|
| 4,153,485 | 5/1979 | Ogata et al. | 148/126 |
| 4,693,864 | 9/1987 | Lloyd | 419/23 |
| 4,885,133 | 12/1989 | Fjuii | 419/29 |
| 4,966,626 | 10/1990 | Fujiki et al. | 75/238 |
| 5,009,842 | 4/1991 | Hendrickson et al. | 419/28 |
| 5,108,493 | 4/1992 | Causton | 75/255 |
| 5,154,881 | 10/1992 | Rutz et al. | 419/37 |
| 5,188,659 | 2/1993 | Purnell | 75/246 |

*Primary Examiner*—Donald P. Walsh
*Assistant Examiner*—John N. Greaves
*Attorney, Agent, or Firm*—Eugene J. A. Gierczak

[57] ABSTRACT

A process of coining sintered articles of powder metal comprising: blending carbon, ferro manganese, and lubricant with compressible elemental iron powder, pressing the blended mixture to form the articles, high temperature sintering of the articles in a reducing atmosphere and then coining the sintered articles to final shape so as to narrow the tolerance variability of coined articles and substantially eliminate secondary operations.

17 Claims, 6 Drawing Sheets

| | | Typical Dimensional Distributions | |
|---|---|---|---|
| | | FeCuC | FeMnC |
| Minor ø Print 140.00 Tol. 139.70 | 139.700 | . | . |
| | 139.720 | . | . |
| | 139.740 | . | . |
| | 139.760 | . | . |
| | 139.780 | . | . |
| | 139.800 | . | . |
| | 139.820 | + | . |
| | 139.840 | +++ | + |
| | 139.860 | +++ | +++++++++++++++++ |
| | 139.880 | +++ | + |
| | 139.900 | +++++ | . |
| | 139.920 | +++ | . |
| | 139.940 | ++ | . |
| | 139.960 | . | . |
| | 139.980 | . | . |
| | 140.000 | . | . |
| Major ø Print 151.20 Tol. 151.00 | 151.000 | . | . |
| | 151.020 | . | . |
| | 151.040 | . | . |
| | 151.060 | . | . |
| | 151.080 | ++ | . |
| | 151.100 | +++ | +++++++++++++++++ |
| | 151.120 | ++ | ++ |
| | 151.140 | ++++++++++ | . |
| | 151.160 | ++ | . |
| | 151.180 | . | . |
| | 151.200 | . | . |

Figure 7

SINTERED COINING PROCESS

FIELD OF INVENTION

This invention relates to a process of coining sintered articles to final shape and in particular relates to a process of precision coining sintered articles of powder metal having a composition of between 0.3% to 2.0% manganese, 0.2 to 0.85% carbon with the remainder being iron and unavoidable impurities where the sintered articles are coined to final shape so as to narrow the tolerance variability of the coined articles.

BACKGROUND TO THE INVENTION

Powder metal technology is well known to the persons skilled in the art and generally comprises the formation of metal powders which are compacted and then subjected to an elevated temperature so as to produce a sintered product.

Conventional sintering occurs at a maximum temperature of approximately up to 1,150° C. Historically the upper temperature has been limited to this temperature by sintering equipment availability. Therefore copper and nickel have traditionally been used as alloying additions when sintering has been conducted at conventional temperatures of up to 1,150° C., as their oxides are easily reduced at these temperatures in a generated atmosphere, of relatively high dew point containing CO, $CO_2$ and $H_2$. The use of copper and nickel as an alloying material is expensive. Moreover, copper when utilized in combination with carbon as an alloying material and sintered at high temperatures causes dimensional instability and accordingly the use of same in a high temperature sintering process results in a more difficult process to control the dimensional characteristics of the desired product.

Manufacturers of metal powders utilized in powder metal technology produce prealloyed iron powders which are generally more difficult to compact into complex shapes, particularly at higher densities (>7.0 g/cc). Manganese and chromium can be incorporated into prealloyed powders provided special manufacturing precautions are taken to minimize the oxygen content, for example, by oil atomization.

Notwithstanding this, these powders still have poor compressabilities compared to admixed powders.

Conventional means to increase the strength of powder metal articles use up to 8% nickel, 4% copper and 1.5% molybdenum, in prealloyed, partially prealloyed, or admixed powders. Furthermore double press double sintering can be used for high performance parts as a means of increasing part density. Conventional elements are expensive and relatively ineffective for generating mechanical properties equivalent to wrought steel products, which commonly use the more effective strengthening alloying elements manganese and chromium.

Moreover, conventional technology as disclosed in U.S. Pat. No. 2,402,120 teach pulverizing material such as mill scale to a very fine sized powder, and thereafter reducing the mill scale powder to iron powder without melting it.

Furthermore, U.S. Pat. No. 2,289,569 relates generally to powder metallurgy and more particularly to a low melting point alloy powder and to the usage of the low melting point alloy powders in the formation of sintered articles.

Yet another process is disclosed in U.S. Pat. No. 2,027,763 which relates to a process of making sintered hard metal and consists essentially of steps connected with the process in the production of hard metal. In particular, U.S. Pat. No. 2,027,763 relates to a process of making sintered hard metal which comprises producing a spray of dry, finely powdered mixture of fusible metals and a readily fusible auxiliary metal under high pressure producing a spray of adhesive agent customary for binding hard metals under high stress, and so directing the sprays that the spray of metallic powder and the spray of adhesive liquid will meet on their way to the molds, or within the latter, whereby the mold will become filled with a compact moist mass of metallic powder and finally completing the hard metallic particle thus formed by sintering.

U.S. Pat. No. 4,707,332 teaches a process for manufacturing structural parts from intermetallic phases capable of sintering by means of special additives which serve at the same time as sintering assists and increase the ductility of the finished structural product.

Moreover, U.S. Pat. No. 4,464,206 relates to a wrought powder metal process for pre-alloyed powder. In particular, U.S. Pat. No. 4,464,206 teaches a process comprising the steps of communinuting substantially non-compactible prealloyed metal powders so as to flatten the particles thereof heating the communinuted particles of metal powder at an elevated temperature, with the particles adhering and forming a mass during heating, crushing the mass of metal powder, compacting the crushed mass of metal powder, sintering the metal powder and hot working the metal powder into a wrought product.

Finally, coining is a process well known to those persons skilled in the art. However, a comprehensive method of precision coining of powder metal blanks is lacking. For example, U.S. Pat. No. 2,757,446 teaches a method of forming articles from metal powders which includes hot forging the article to a minimum density of 95% of the theoretical density wherein the entire change of shape of the article takes places in one direction of movement and wherein the minimum internal flow of the particles within the article is at least 5% and finally finishing the forged article.

The processes as described in the prior art above present a relatively less cost effective process to achieve the desired mechanical properties of the sintered product.

It is an object of this invention to provide an improved coining process for producing sintered articles having improved dynamic strength characteristics and an accurate method to control same, while at the same time narrowing the tolerance variability of the coined articles.

It is an aspect of this invention to provide a process of coining sintered articles of powder metal comprising blending carbon, ferro manganese and lubricant with compressible elemental iron powder, pressing said blended mixture to form said articles, high temperature sintering said articles in a reducing atmosphere and then coining said sintered articles to a final shape.

It is another aspect of this invention to provide a process of precision coining a sintered article of powder metal comprising: selecting elemental iron powder; determining the desired properties of said sintered article and selecting; a quantity of carbon; and a quantity of ferro manganese to produce an article having a composition of between 0.3% to 2.0% manganese, 0.2% to 0.85% carbon with the remainder being iron and unavoidable impurities; grinding said ferro manganese to a mean particle size of approximately 8 to 12 microns and substantially all of said ferro manganese having a particle size of less than 25 microns; introducing a lubricant while blending said carbon, and ferro manganese with said elemental iron powder; pressing said mixture to form said article; high temperature sintering said article at a temperature between 1,250° C. and 1,350° C. in a reducing atmosphere of 90% blended nitrogen and 10% hydrogen so as to produce said sintered article of powdered metal; then coining said sintered article to a final shape so as to narrow the tolerance variability of coined articles and substantially eliminate secondary operations.

It is another aspect of this invention to provide coined as sintered articles having a compacted and sintered mass with composition of between 0.3% to 2.0% manganese, 0.2% to 0.85% carbon, with the remainder being iron and unavoidable impurities, with a narrow dimensional tolerance variability.

DESCRIPTION OF DRAWINGS

These and other features and objections of the invention will now be described in relation to the following drawings:

FIG. 7 is a dimensional stability graph.

DESCRIPTION OF THE INVENTION

Sintered Powder Metal Method

Figure 1:
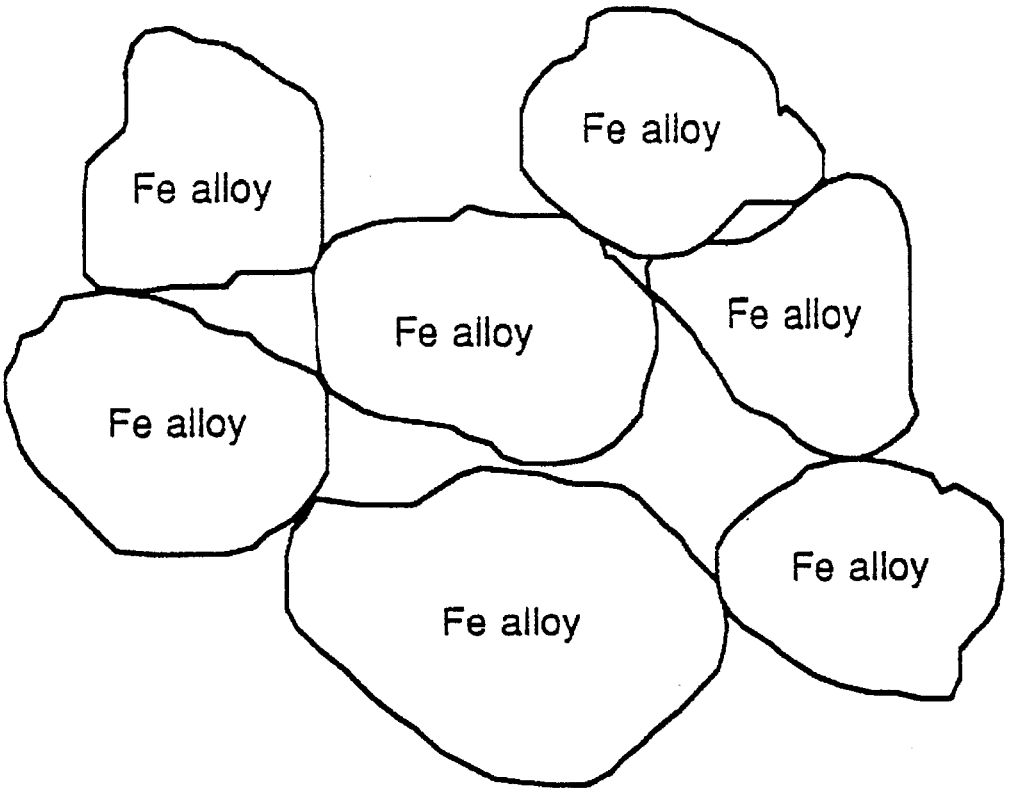
FIG. 1 is a drawing of the prior art mixture of iron alloy.

FIG. 1 is a representative view of a mixture of powder metal utilized in the prior art which consists of particles of ferro alloy in powder metal technology.

In particular, copper and nickel may be used as the alloying materials, particularly if the powder metal is subjected to conventional temperature of up to 1150° C. during the sintering process.

Moreover, other alloying materials such as manganese, chromium, and molybdenum which were alloyed with iron could be added by means of a master alloy although such elements were tied together in the prior art. For example a common master alloy consists of 22% of manganese, 22% of chromium and 22% of molybdenum, with the balance consisting of iron and carbon. The utilization of the elements in a tied form made it difficult to tailor the mechanical properties of the final sintered product for specific applications. Also the cost of the master alloy is very high and uneconomic.

By utilizing ferro alloys which consist of ferro manganese, or ferro chromium or ferro molybdenum or ferro vanadium, separately from one another rather than utilizing a ferro alloy which consists of a combination of iron, with manganese, chromium, molybdenum or vanadium tied together a more accurate control on the desired properties of the finished product may be accomplished so as to produce a method having more flexibility than accomplished by the prior art as well as being more cost effective.

Figure 2:
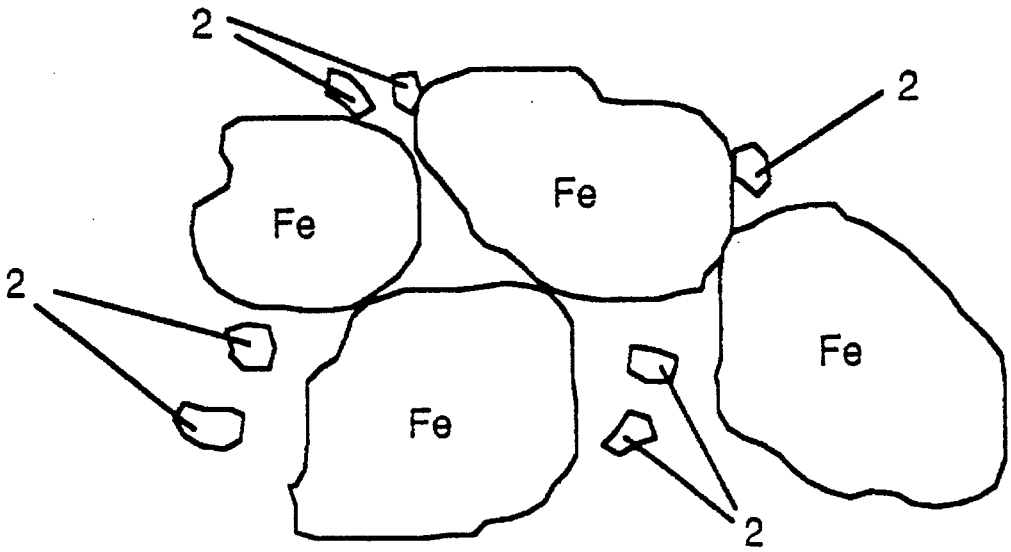
FIG. 2 is a drawing of a mixture of elemental iron, and ferro alloy in accordance with the invention described herein.

FIG. 2 is a representative drawing of the invention to be described herein, which consists of iron particles, Fe having a mixture of ferro alloys 2.

The ferro alloy 2 can be selected from the following groups:

| Name | Symbol | Approx. % of Alloy Element |
|---|---|---|
| ferro manganese | FeMn | 78% |
| ferro chromium | FeCr | 65% |
| ferro molybdenum | FeMo | 71% |
| ferro vanadium | FeVa | 75% |
| ferro silicon | FeSi | 75% |
| ferro boron | FeB | 17.5% |

The ferro alloys available in the market place may also contain carbon as well as unavoidable impurities which is well known to those people skilled in the art.

Chromium molybdenum and vanadium are added to increase the strength of the finished product particularly when the product is subjected to heat treatment after sintering. Moreover, manganese is added to increase the strength of the finished product, particularly if one is not heat treating the product after the sintering stage. The reason for this is manganese is a powerful ferrite strengthener (up to 4 times more effective than nickel).

Figure 3:
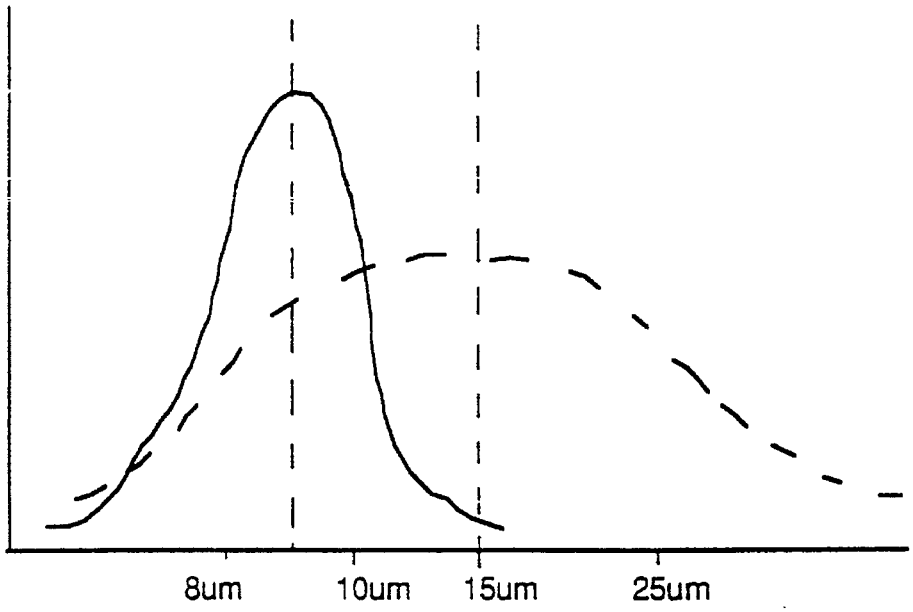
FIG. 3 is a graph showing the distribution of particle size in accordance with the invention herein.

Particularly good results are achieved in the method described herein by grinding the ferro alloys so as to have a $D_{50}$ or mean particle size of 8 to 12 microns and a $D_{100}$ of up to 25 microns where substantially all particles of the ferro alloys are less than 25 microns as shown in FIG. 3. For certain application a finer distribution may be desirable. For example a $D_{50}$ of 4 to 8 microns and a $D_{100}$ of 15 microns.

Many of the processes used in the prior art have previously used a $D_{50}$ of 15 microns as illustrated by the dotted lines of FIG. 3. It has been found that by finely grinding the of the ferro alloy to a fine particle size in an inert atmosphere as described herein a better balance of mechanical properties may be achieved having improved sintered pore morphology. In other words the porosity is smaller and more rounded and more evenly distributed throughout the mass which enhances strength characteristics of the finished product. In particular, powder metal products are produced which are much tougher than have been achieved heretofore.

The ferro alloy powders may be ground by a variety of means so long as the mean particle size is between 8 and 12 microns. For example, the ferro alloy powders may be ground in a ball mill, or an attritor, provided precautions are taken to prevent oxidation of the ground particles and to control the grinding to obtain the desired particle size distribution.

Figure 4:
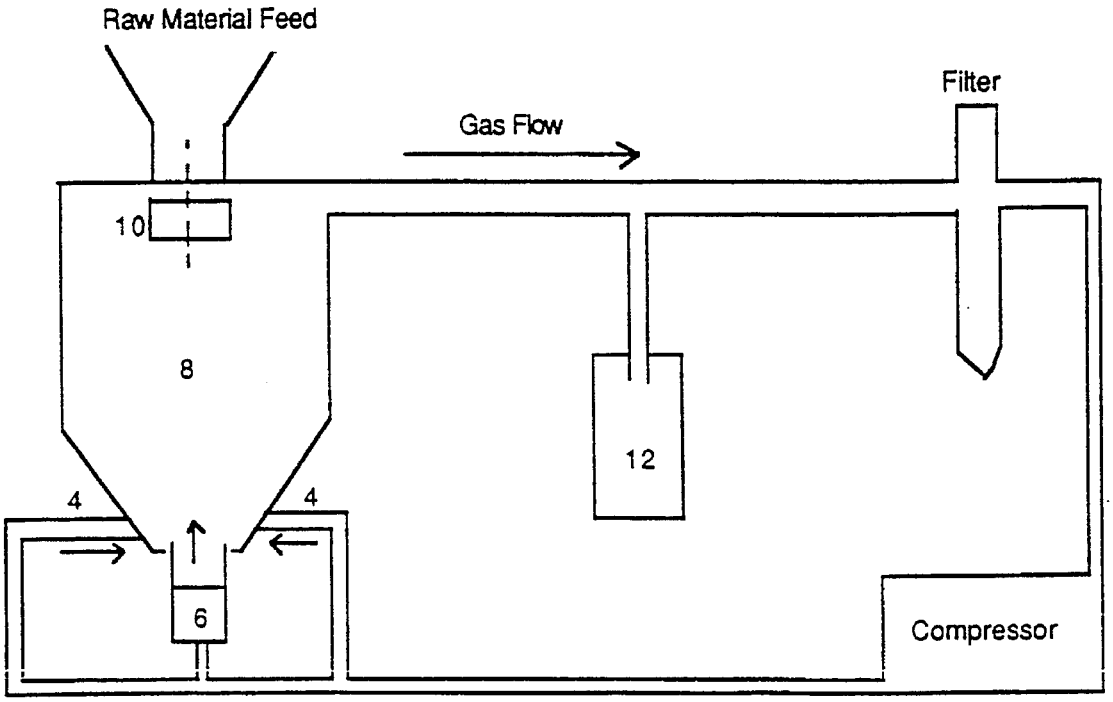
FIG. 4 is representative drawing of a jet mill utilized to produce the particle size of the ferro alloy.

Particularly good results in controlling the particle size as described herein are achieved by utilizing the jet mill illustrated in FIG. 4. In particular, an inert gas such as cyclohexane, nitrogen or argon is introduced into the grinding chamber via nozzles 4 which fluidize and impart high energy to the particles of ferro alloys 6 upward and causes the ferro alloy particles to break up against each other. As the ferro alloy particles grind up against each other and reduce in size they are lifted higher up the chamber by the gas flow and into a classifier wheel 10 which is set at a particular RPM. The particles of ferro alloy enter the classifier wheel 10 where the ferro alloy particles which are too big are returned into the chamber 8 for further grinding while particles which are small enough namely those particles of ferro alloy having a particle size of less than 25 microns pass through the wheel 10 and collect in the collecting zone 12. The grinding of the ferro alloy material is conducted in an inert gas atmosphere as described above in order to prevent oxidization of the ferro alloy material. Accordingly, the grinding mill shown in FIG. 4 is a totally enclosed system. The jet mill which is utilized accurately controls the size of the particles which are ground and produces a distribution of ground particles which are narrowly centralized as shown in FIG. 3. The classifier wheel speed is set to obtain a $D_{50}$ of 8 to 10 microns. The speed will vary with different ferro alloys being ground.

The mechanical properties of a produced powder metal product may be accurately controlled by:

(a) selecting elemental iron powder;

(b) determining the desired properties of the sintered article and selecting:

(i) a quantity of carbon; and (ii) the ferro alloy(s) from the group of ferro manganese, ferro chromium, ferro molybdenum, and ferro vanadium and selecting the quantity of same;

(c) grinding separately the ferro alloy(s) to a mean particle size of approximately 8 to 12 microns, which grinding may take place in a jet mill as described herein;

(d) introducing a lubricant while blending the carbon and ferro alloy(s) with the elemental iron powder;

(e) pressing the mixture to form the article; and (f) subjecting the article to a high temperature sintering at a temperature of between 1,250° C. and 1,350° C. in a reducing atmosphere of, for example 90% hydrogen and 10% hydrogen.

The lubricant is added in a manner well known to those persons skilled in the art so as to assist in the binding of the powder as well as assisting in the ejecting of the product after pressing. The article is formed by pressing the mixture into shape by utilizing the appropriate pressure of, for example, 25 to 50 tonnes per square inch.

The invention disclosed herein utilizes high temperature sintering of 1,250° C. to 1,350° C. and a reducing atmosphere of, for example nitrogen and hydrogen in a 90/10% ratio, or in vacuum. Moreover, the reducing atmosphere in combination with the high sintering temperature reduces or cleans off the surface oxides allowing the particles to form good bonds and the compacted article to develop the appropriate strength. A higher temperature is utilized in order to create the low dew point necessary to reduce the oxides of manganese and chromium which are difficult to reduce. The conventional practice of sintering at 1150° C. does not create a sintering regime with the right combination of low enough dew point and high enough temperature to reduce the oxides of chromium, manganese, vanadium and silicon.

Secondary operations such as machining or the like may be introduced after the sintering stage. Moreover, heat treating stages may be introduced after the sintering stage.

Advantages have been realized by utilizing the invention as described herein. For example, manganese, chromium and molybdenum ferro alloys are utilized to strengthen the iron which in combination or singly are less expensive than the copper and nickel alloys which have heretofore been used in the prior art. Moreover, manganese appears to be four times more effective in strengthening iron than nickel as 1% of manganese is approximately equivalent to 4% nickel, and accordingly a cost advantage has been realized.

Furthermore sintered steels with molybdenum, chromium, manganese and vanadium are dimensionally more stable during sintering at high temperatures described herein than are iron-copper-carbon steels (ie. conventional powder metal (P/M) steels). Process control is therefore easier and more cost effective than with conventional P/M alloys.

Furthermore, the microstructure of the finished product are improved as they exhibit:

(a) well rounded pores;

(b) a homogenous structure;

(c) structure having a much smaller grain size; and (d) a product that is more similar to wrought and cast steels in composition than conventional powder metal steels.

The process described herein allows one to control or tailor the materials which are desired for a particular application.

(1) sinter hardening grades (2) gas quenched grades (3) as sintered grades (4) high strength grades (5) high ductility grades The following chart provides examples of the five grades referred to above as well as the range of compositions that may be utilized in accordance with the procedure outlined herein.

| | | Typical Mechanical Properties | |
|---|---|---|---|
| Alloy Type | Composition | Ultimate Tensile Strength UTS (ksi) | Impact ft/lb |
| As Sintered | Mn: 0.3–2.5%<br>C: 0.2–0.85% | 90 | 25 |
| Sinter Hardening | Mn: 1.0–2.0%<br>C: 0.5–0.85%<br>Mo: 0–1.0% | 120 | 15 |
| Gas Quenched | Mn: 0.5–2.0%<br>Mo: 0.5–1.5%<br>C: 0–0.8%<br>Cr: 0–1.0% | 150 | 15 |
| High Strength | Mn: 0.5–2.0%<br>Cr: 0.5–2.0%<br>Mo: 0–1.0%<br>C: 0.1–0.6% | 200 | 8 |
| High Ductility | Cr: 0.5–2.0%<br>Mo: 0–1.0%<br>C: 0.1–0.6% | 80 | 15 |

Particularly good results were achieved with the as sintered grade with 1.5% Mn and 0.8% C; UTS of 90 ksi and impact strength of 20 ft lbs. Other combinations of alloying are possible to produce articles with specifically tailored balance of properties such as high toughness and ware resistance.

Moreover good results were achieved with:

(a) sinter hardening grade with 1.5% Mn, 0.5% Mo, and 0.85% C;

(b) gas quenching grade (i) with 1.5% Mn, 0.5% Mo, and 0.5% C (ii) with 0.5% Cr, 1.0% Mn, and 0.5% C (c) high strength grade (i) with 1.0% Mn, 0.5% C, 0.5% Cr, 0.5% Mo (ii) with 1.5% Cr, 0.6% C, 1.0% Mn, Rollable Grade Moreover, the method described herein may be utilized to produce a sixth grade identified as a rollable grade having the following composition:

| | | | |
|---|---|---|---|
| Rollable Grade | Cr: 0.5–2.0%<br>Mo: 0–1.0%<br>C: 0.1–0.6%<br>Mn: 0 to 0.6% | 80 | 15 |

It has been found that the method of producing the as sintered grade as described above is particularly useful when used in combination with a coining operation so as to produce precision coining as sintered parts which substantially eliminate the secondary operations such as grinding, cutting or the like.

In another embodiment, the method of producing the gas quenched grade as described above is also particularly useful when used in combination with said coining operation so as to produce precision coining gas quenched particles which substantially eliminate the secondary operations such as grinding, cutting or the like. In particular it has been found that articles which have a gas quenched composition described herein with relatively small sections do not require molybdenum while heavier parts require the molybdenum.

Figure 6:
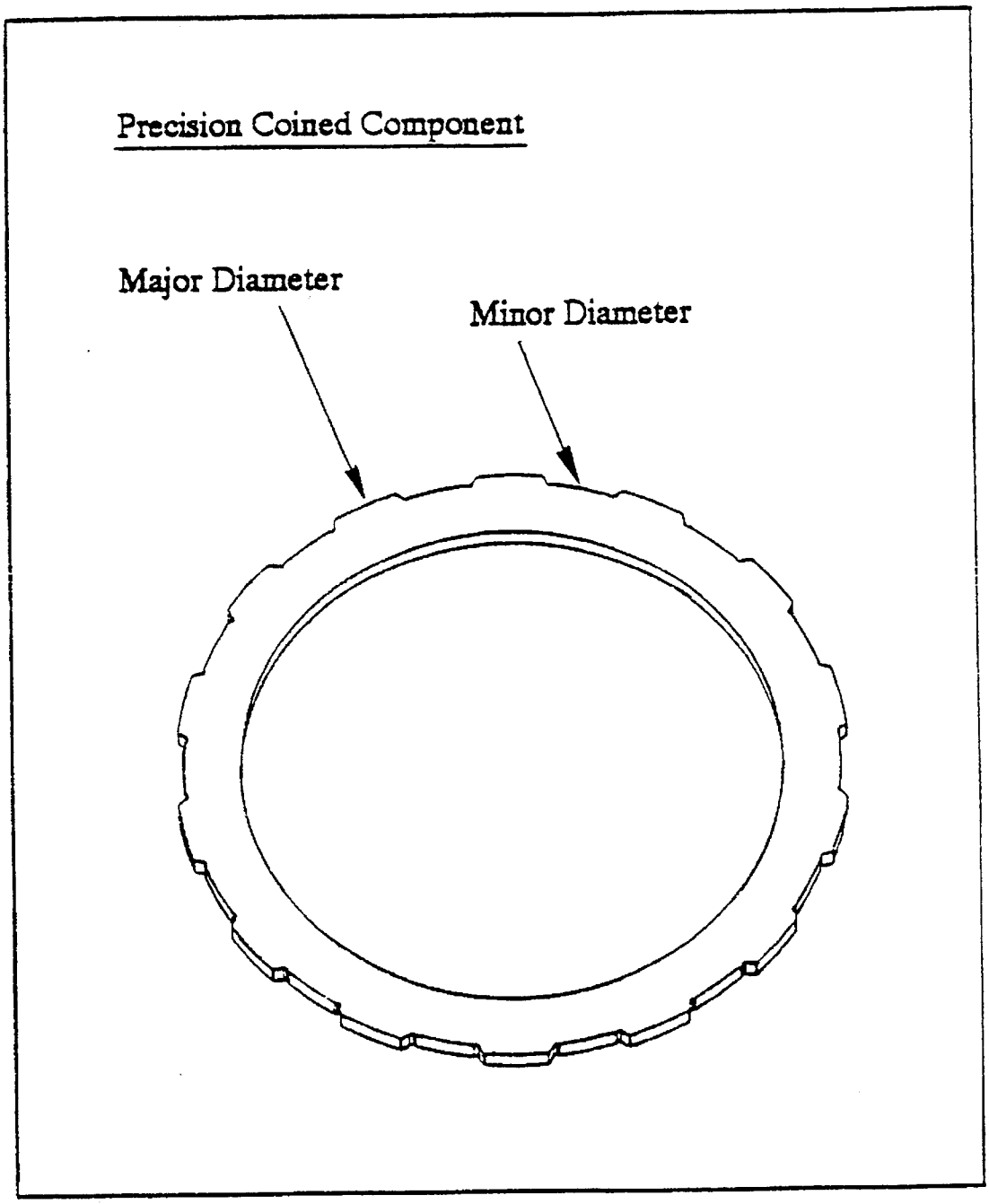
FIG. 6 illustrates a coined part such as a clutch backing plate made in accordance with the invention.

In particular, it has been found that parts such as clutch backing plates illustrated as 30 in FIG. 6, or geo rotors (not shown) may be consistently, accurately manufactured within narrow tolerance variabilities by coining the sintered product.

In particular, the process of precision coining of a sintered article of powder metal consists of the steps of:

1. selecting the elemental iron powder;
2. determining the desired properties of the sintered articles and selecting:
   (a) a quantity of carbon, and;
   (b) a quantity of ferro manganese;

to produce an article having a composition of between 0.3% to 2.5% manganese, 0.2% to 0.85% carbon with the remainder being iron and unavoidable impurities;

3. grinding the ferro alloy to a mean particle size of approximately 8 to 12 microns and substantially all of the ferro alloy having a particle size of less than 25 microns;
4. introducing a lubricant while blending the carbon and ferro alloy with the elemental iron powder; and
5. pressing the mixture to form the article;
6. high temperature sintering the article at a temperature between 1,250° C. 1,350° C. in a reducing atmosphere of for example 90% blended nitrogen and 10% hydrogen so as produce the sintered article of powdered metal; and
7. then coining the sintered article to a final shape so as to narrow the tolerance variability of coined articles and substantially eliminate secondary operations.

Another embodiment of the invention comprises:

1. selecting the elemental iron powder;
2. determining the desired properties of the gas quenched grade articles and selecting:
   (a) a quantity of carbon, and
   (b) a quantity of ferro alloys from the group of ferro manganese, ferro molybdenum and ferro chromium so as to produce a sintered blank resulting in a mass having between 0.5 to 2.0% manganese, 0.5% to 1.5% molybdenum, between 0 to 1.0% chromium, and between 0 to 0.8% carbon;
3. grinding the ferro alloy to a mean particle size of approximately 8 to 12 microns and substantially all of the ferro alloy having a particle size of less than 25 microns;
4. introducing a lubricant while blending the carbon and ferro alloy with the elemental iron powder; and
5. pressing the mixture to form the article;
6. high temperature sintering the article at a temperature between 1,250° C. 1,350° C. in a reducing atmosphere of for example 90% blended nitrogen and 10% hydrogen so as produce the sintered article of powdered metal; and
7. then coining the sintered article to a final shape so as to narrow the tolerance variability of coined articles and substantially eliminate secondary operations.

Figure 5:
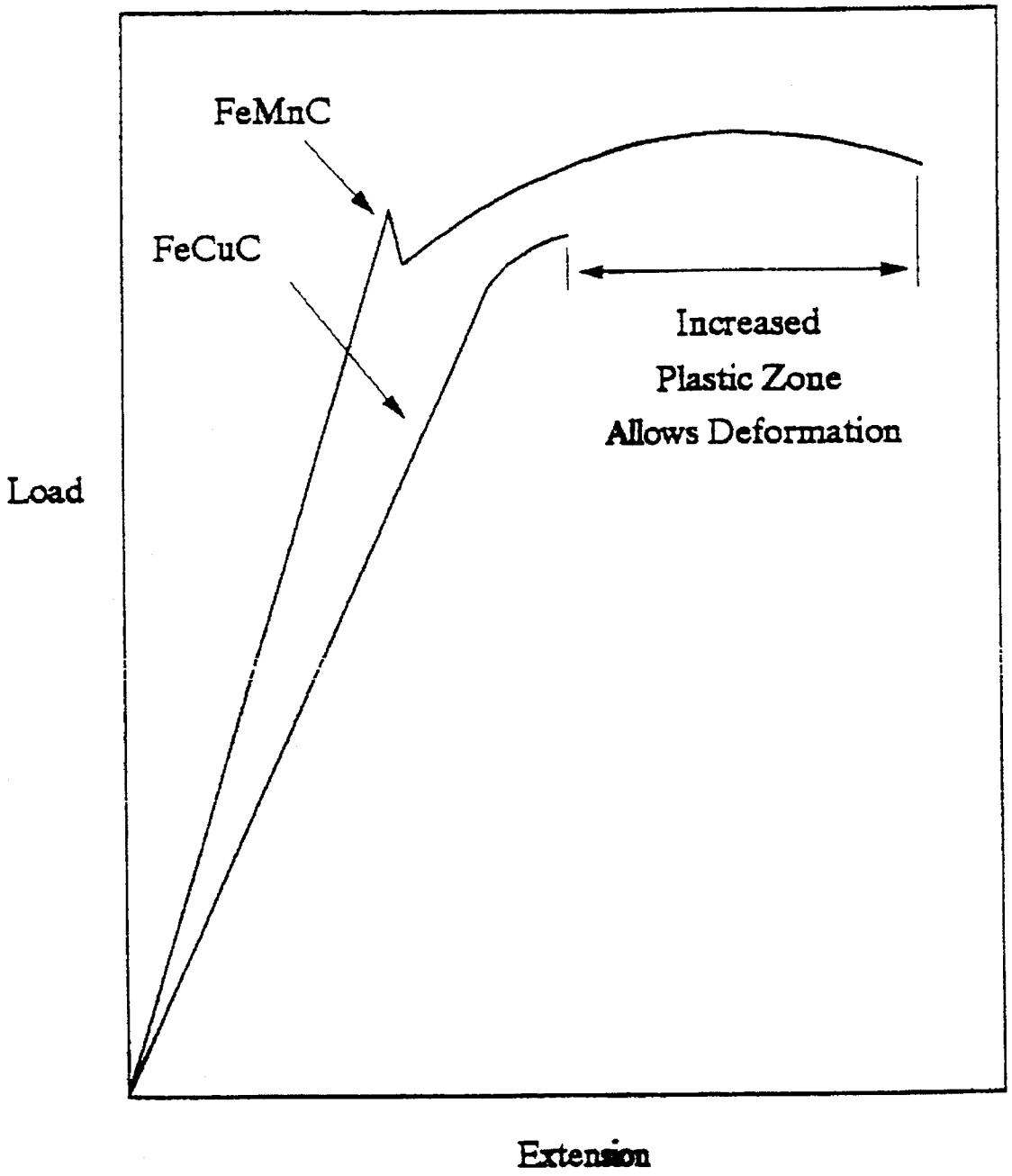
FIG. 5 is a stress strain graph.

In particular, FIG. 5 illustrates the stress strain diagram of coining sintered articles having the prior art composition of FeCuC as well as the lower graph which illustrates the stress strain relationship of an article produced in accordance with the method described herein having a composition of between 0.3% to 2.5% manganese, 0.2% to 0.85% carbon, with the remainder being iron and unavoidable impurities. The stress strain diagram of the composition described herein illustrates the plastic zone 32 which allows the sintered blank to move upon coining to its final shape. The as sintered size change variability is less than in conventional PM materials, on coining this variability is further reduced.

Figure 8:
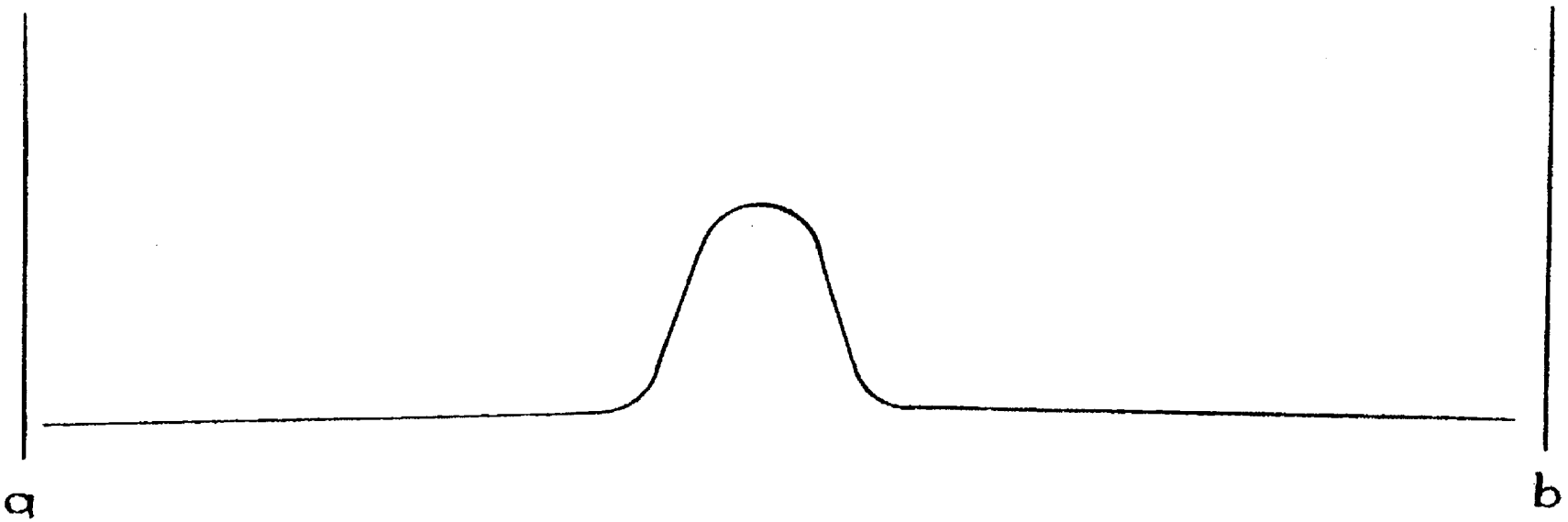
FIG. 8 graphically illustrates the narrow variability tolerance of the coined parts.

More particularly, FIG. 7 illustrates two dimensions which have an acceptable tolerance level of between 140.00 to 139.70 as well as a second part having an acceptable tolerance of between 1.51.20 and 1.51.00. The upper portion of the graph in FIG. 7 illustrates that a coined article made from a prior art composition of FeCuC (0.1% to 3% Cu and 0.5% to 0.8% Carbon) has dimensional variability between 139.820 and 139.940 which peaks approximately between said levels. The tolerance variability of the parts produced with a composition of Fe 0.3 to 2.5% Mn and 0.2 to 0.85% C is more acceptable since the tolerance variability ranges from 139.840 to 139.880 peaking at 139.860, and since the tolerance variation lies in the middle of the acceptable tolerance range. In other words if the CPK as illustrated in FIG. 8 lies in the middle of the acceptable tolerance range a and b, such tolerance variability is desirable particularly since the variation peaks in the middle which takes up approximately one-third of the tolerance.

More particularly, it has been found that the CPK of the coined as sintered article having a composition of Fe 0.3 to 2.5% Mn and 0.2 to 0.85% C has the desirable CPK of greater than or equal to 1.33. If the CPK shifts from this position, it is less desirable. In other words, the CPK illustrated in FIG. 7 relating to a composition of Fe 0.3 to 2.5% Mn and 0.2 to 0.85% C is more desirable than the CPK illustrated in the composition of Fe 0.1% to 3% Cu and 0.5% to 0.8% C. (Although the tolerance variability is still acceptable, it does not lie toward the middle range of the acceptable tolerance level).

It has been found that after producing the sintered article by the sintered grade method described above, one can expect a CPK grade of 0.5. However, upon coining of a part made in accordance with the as sintered grade, one can expect to obtain a CPK of greater than or equal to 1.33 which is highly desirable as the coined sintered powder metal parts will be more uniform in dimensional size thus substantially eliminating secondary operations such as grinding or the like.

CP relates to the "Process Capability Index" and is defined as $$CP = \frac{\text{Total Tolerance}}{\text{Process Variation}}$$

The higher the CP the less variation there is in a process. In other words CP measures the tightness of the spread in the dimensions produced by the process against the acceptable tolerance. The bigger the spread the lower the CP.

The CPK is the combined measure of variation in process and relationship of process average to specification limit (ie. upper and lower limit).

The higher the CPK the more capable a process is to specification. In other words CPK measures the tightness of the spread as well as the position of the spread within the acceptable tolerance. A high CPK translates to parts having a narrow tolerance spread positioned in the middle of the acceptable tolerance. The CPK can be changed by changing the tooling or process.

Sintered powder metal parts such as clutch backing plates, geo rotors or the like normally require grinding which increases the cost of same and increases the tolerance variability of successively manufactured parts. By utilizing the process as described herein one is able to tighten down the tolerances of coined as sintered powder metal parts thereby facilitating the design of more efficient pumps for example due to the tightening of the tolerance levels.

The as sintered powder metal parts produced in accordance with the invention described herein make it possible for sintered material to flow to final dimensional size as the coining takes place in the plastic zone 32 described above.

Although the preferred embodiment as well as the operation and use have been specifically described in relation to the drawings, it should be understood that variations in the preferred embodiment could be achieved by a person skilled in the trade without departing from the spirit of the invention as claimed herein.

The embodiments of the invention in which an exclusive property or privilege is claimed are defined as follows:

1. A coining process for blending, sintering, and coining powder metal articles, that coining process comprising:

blending carbon, ferro manganese and lubricant with compressible iron powder to form a blended mixture;

pressing said blended mixture to form said articles;

sintering said articles in a reducing atmosphere at a temperature of at least 1250°C.; and coining said sintered articles to a final shape.

2. The coining process of claim 1 wherein said ferro alloy has a mean particle size of approximately 8 to 12 microns and substantially all of said ferro manganese has a particle size of less than 25 microns.

3. The coining process of claim 1 wherein said article has a final composition of between 0.3% to 2.5%, by weight, manganese, between 0.2% to 0.85%, by weight, carbon, with the remainder being iron and unavoidable impurities.

4. The coining process of claim 1 wherein said sintering is undertaken under a vacuum.

5. The coining process of claim 3 wherein said reducing atmosphere is chosen from a) a blended nitrogen-hydrogen atmosphere, or b) a dissociated ammonia atmosphere.

6. The coining process of claim 1 wherein each of said articles has a composition, by weight, of between 0.5 and 2.0% Manganese, between 0.5% and 1.5% Molybdenum, up to 1.0% Chromium and up to 0.8% Carbon.

7. The coining process of claim 1 wherein said sintering is conducted at a temperature between 1,250° C. and 1,350° C.

8. The coining process of claim 7 wherein said ferro alloy is ground in an atmosphere of inert gas, and said article has a CPK value greater than 1.33 after coining.

9. A process of precision coining a sintered article of powder metal comprising:

(a) selecting iron powder;

(b) determining the desired properties of said sintered article and selecting:

(i) a quantity of carbon; and (ii) a quantity of ferro manganese to produce an article having a composition of between 0.3% to 2.0% manganese, 0.2% to 0.85% carbon with the remainder being iron and unavoidable impurities;

(c) grinding separately said ferro manganese to a mean particle size of approximately 8 to 12 microns and substantially all of said ferro manganese having a particle size of less than 25 microns;

(d) introducing a lubricant while blending said carbon, and ferro manganese with said iron powder;

(e) pressing said mixture to form said article;

(f) sintering said article at a temperature between 1,250° C. and 1,350° C. in a vacuum or reducing atmosphere of 90% blended nitrogen and 10% hydrogen to produce said sintered article of powdered metal;

(g) coining said sintered article to a final shape to narrow the dimensional tolerance variability of coined articles and substantially eliminate secondary operations.

10. The coining process of claim 1 wherein said coining dimensionally sizes said coined sintered article,

11. The process as claimed in claim 9 wherein said tolerance variability has a CPK of greater than or equal to 1.33.

12. The process as claimed in claim 11 wherein said sintered article presents a sintered form deformable to its final shape upon coining.

13. Coined, as sintered articles produced by the process of claim 9 wherein said articles have a compacted and sintered mass with composition of between 0.3% to 2.0% manganese, 0.2% to 0.85% carbon, with the remainder being iron and unavoidable impurities, said articles having a narrow tolerance variability giving a CPK greater than or equal to 1.33.

14. The articles as claimed in claim 13 wherein said articles comprise at least one clutch backing plate.

15. The articles as claimed in claim 13 wherein said articles comprise a gerotor.

16. A process of gas quenching coined articles of powder metal, that process comprising:

blending carbon, ferro manganese, ferro molybdenum, ferro chromium and lubricant with compressible iron powder;

pressing said blended mixture to form said articles;

sintering said articles at a temperature in the range of 1250° C. to 1350° C. in a reducing atmosphere;

coining said articles to a final form:

and gas quenching said article.

17. A process as claimed in claim 16 wherein said article has a composition of between 0.5% to 2.0% manganese, between 0.5% to 1.5% molybdenum, 0 to 1.0% chromium and between 0 to 0.8% carbon.

* * * * *